United States Patent [19]

Mealing et al.

[11] 4,368,554

[45] Jan. 18, 1983

[54] ROAD SWEEPING APPARATUS

[75] Inventors: Barrie E. Mealing; Raymond H. Payne, both of Warwick; James Boswell, Coventry, all of England

[73] Assignee: Hestair Eagle Limited, Warwick, England

[21] Appl. No.: 206,205

[22] Filed: Nov. 12, 1980

[30] Foreign Application Priority Data

Mar. 28, 1980 [GB] United Kingdom ..... 8010457
Jun. 14, 1980 [GB] United Kingdom ..... 8019528

[51] Int. Cl.[3] ..... E01H 1/05; E01H 1/08

[52] U.S. Cl. ..... 15/354; 15/87; 15/340; 15/383; 15/385

[58] Field of Search ..... 15/340, 87, 383, 385, 15/354

[56] References Cited

U.S. PATENT DOCUMENTS 3,292,195 12/1966 Schmidt et al. ..... 15/87
3,825,968 7/1974 Larsen ..... 15/87
3,886,623 6/1975 Landesman et al. ..... 15/340 X
4,160,302 7/1979 Hirst et al. ..... 15/340

*Primary Examiner*—Chris K. Moore
*Attorney, Agent, or Firm*—Pollock, Vande Sande and Priddy

[57] ABSTRACT

A self-propelled road sweeper has brush gear comprising a narrow sweep brush and a wide sweep brush, together with an associated refuse collecting nozzle. The narrow sweep brush is mounted on a linkage comprising pivotally connected inner and outer mounting links and controlled by pneumatic actuators whereby the position of the brush and its downward loading is controlled. The brush can be tilted by one of said actuators. One of the mounting links is connected to the sweeper frame through a resilient mounting permitting the brush to yield under impact. The application also discloses details of the mounting and structure of the wide sweep brush, and of the mounting and fabrication of the nozzle and of a mechanism for tilting the nozzle.

24 Claims, 8 Drawing Figures

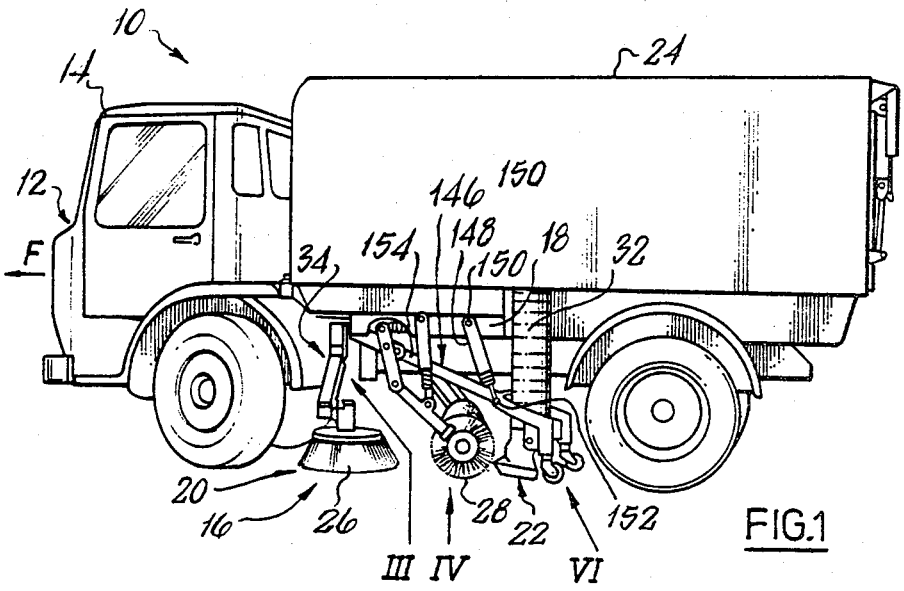
FIG.1
FIG.2
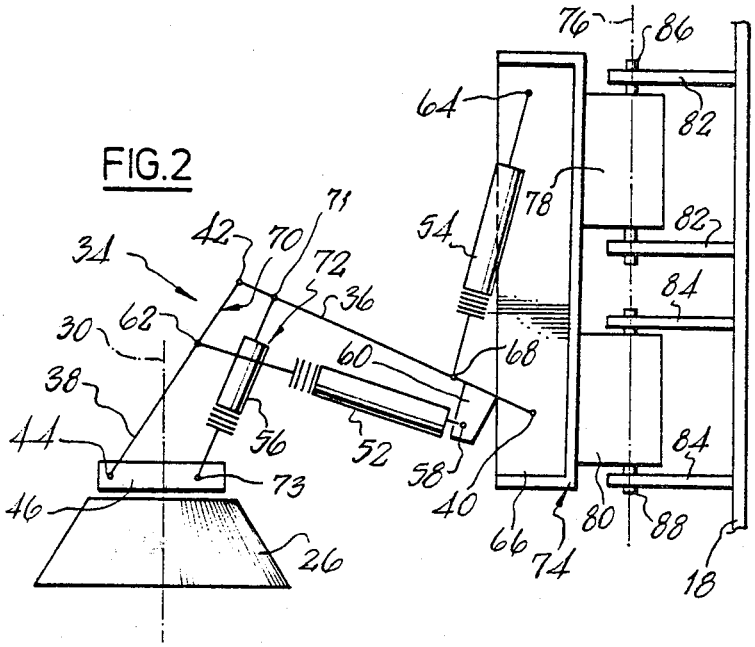

FIG.7
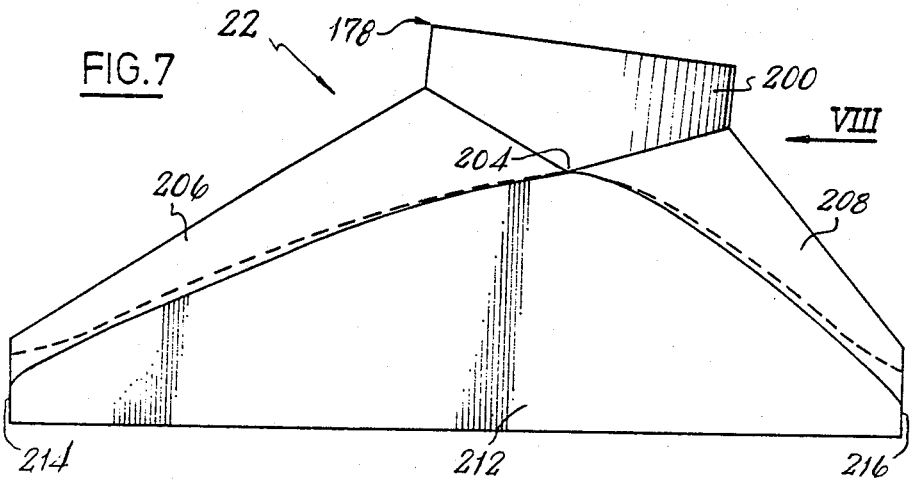
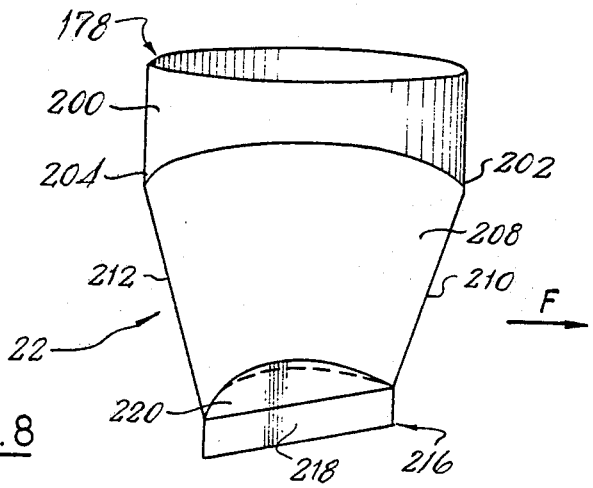
FIG.8

ROAD SWEEPING APPARATUS

This invention relates to road sweeping apparatus such as, for example, road sweeping apparatus to be mounted on a self-propelled chassis to form a self-propelled road sweeping vehicle.

In this specification and in the claims, the expression "road sweeping apparatus" is to be interpreted as covering also apparatus similar to road sweeping apparatus but which is intended primarily for sweeping other large surfaces such as pavements or sidewalks, airport runways and the like.

The present invention is concerned with aspects of the design of the brush gear and refuse collecting nozzle used in road sweeping apparatus. The components of the brush gear and nozzle system cooperate and interact and are functionally interdependent on each other. Currently available road sweeping apparatus is considered to be inadequate in relation to certain aspects of the mounting and control of the brush gear and the refuse collecting nozzle. Other necessary improvements relate to the construction and fabrication of the brush gear and the nozzle.

A first aspect of the present invention relates more specifically to the mounting of the narrow sweep or scarifying brush. The scarifying brush is usually mounted on the road sweeping apparatus so as to project laterally therefrom. It is mounted for rotation by a drive to effect sweeping in the region of one side of the apparatus and serves to sweep gutters and the like, which cannot be swept by a cylindrical wide sweep brush. The scarifying brush thus projects from the road sweeping apparatus in its working position, but it is desirable that the brush can be moved to a retracted transport position for times when the vehicle is travelling along the highway but not sweeping, that is when going to and from its working location.

Conventionally, the scarifying brush has usually been mounted on a linkage which is constructed to permit the brush to swing rearwards to a stowed position for transport. However, if a cylindrical wide sweep brush is to be provided having a width comparable to the total width of the road sweeping apparatus, as is desirable for efficient sweeping, then there is insufficient room available to swing the scarifying brush to a stowed position in this manner.

Further constraints upon the design of a mounting for the scarifying brush are the desirability for it to be able to move laterally in and out during work so as to follow the contours of the edge of the road, and for it to maintain an optimum attitude relative to the surface being swept during such in and out movement, and for the provision of adequate ground clearance in the retracted position of the brush to avoid damage on uneven ground at tipping sites, and for the provision of the facility to vary the downthrust and/or the outwardly-directed thrust on the brush and for the brush to be resistant to impact damage during sweeping operations.

An object of the present invention is to provide road sweeping apparatus offering improvements in respect of one or more of the problems and design factors identified above.

According to the invention there is provided road sweeping apparatus comprising:

a frame or body;

a brush and mounting and drive means therefor whereby the brush is rotatable to effect sweeping in the region of one side of the apparatus;

a refuse tank; and refuse collecting and transfer means associated with the brush to collect material swept by the brush, and to transfer the material to the tank;

characterized in that the mounting means for mounting the brush on the frame or body comprises:

an inner mounting link;

an outer mounting link; and actuating means for said links;

the inner mounting link being connected at its inner end of the frame or body and being pivotally connected at its outer end to the adjacent end of the outer mounting link;

the outer mounting link being connected at its outer end to the brush; and the actuating means being connected to said links and being operable to cause angular movement of the links relative to each other whereby the linkage formed thereby extends and retracts moving the brush inwards and outwards relative to the frame.

A second aspect of the present invention also relates to the mounting of the scarifying or narrow sweep brush.

A particular problem that arises in relation to the scarifying brush lies in the adoption of a satisfactory attitude for the brush relative to the road surface being swept in order to compromise between the requirements for roads of normal camber and the requirements for roads of extreme camber.

In the case of currently available road sweeping apparatus the attitude adopted for the scarifying brush in order to achieve a satisfactory sweeping action on the majority of roads which are of normal camber results in the brush producing a very unsatisfactory sweeping action in the gutters of roads of extreme camber, and no acceptable means is provided whereby the operator of the road sweeping apparatus can easily adjust the sweeping action and brush gear configuration according to road camber during use.

An object of this aspect of the invention is to provide road sweeping apparatus offering improvements in relation to one or more of the problems identified above.

According to the invention there is provided road sweeping apparatus which includes a remotely operable actuator connected to the brush and operable during sweeping to adjust the attitude of the brush relative to the surface being swept.

Preferably said remotely operable actuator forms part of said mounting means for mounting the brush on the frame or body. Said mounting means may comprise spaced apart link elements each pivotally connected to the brush, one of the link elements comprising said remotely operable actuator.

A third aspect of the present invention relates to another aspect of the mounting of the narrow sweep or scarifying brush.

It will be readily appreciated that in road sweeping apparatus the laterally projecting scarifying brush is subjected to considerable and frequently occurring impacts with immovable objects during its working life as the road sweeper travels up and down thousands of miles of highway. Accordingly, some provision has to be made to allow the scarifying brush to yield under impact with such objects, otherwise it will be irreparably damaged.

In currently available road sweepers a great variety of brush mounting linkages are provided but in many cases resistance to impact damage is very unsatisfactory.

An object of this aspect of the present invention is to provide road sweeping apparatus in which the mounting of the scarifying brush offers improvements in relation to the problems identified above.

According to this aspect of the present invention there is provided road sweeping apparatus wherein the mounting means for the brush comprises a link connected at its outer end to the brush and connected at its inner end to the frame through resilient mounting means.

Preferably said resilient mounting means permits angular movement of said link about an upwardly extending axis so that the brush can yield under impact with fixed objects encountered during movement of the road sweeping apparatus in the normal forward direction during use.

A fourth aspect of the present invention relates to the rotatable cylindrical brush which extends laterally with respect to the direction of operative forward motion of road sweeping apparatus during use. More particularly, the invention relates to the mounting means for this cylindrical brush.

Previous proposals relating to the method of mounting the cylindrical or main brush on the frame of the road sweeping apparatus have provided a brush mounting structure which restricts brush performance, for example the brush has not been sufficiently free to float in the vertical direction at both of its ends so as to follow road contours or camber, nor could it be adjusted to sweep material to either end. Provision for maintenance has also been unsatisfactory.

An object of this aspect of the present invention is to provide road sweeping apparatus offering improvements in relation to the mounting of the cylindrical brush.

According to this aspect of the present invention there is provided road sweeping apparatus wherein the mounting means for the cylindrical brush comprises trailing mounting arms connected between the brush and the frame or body, with a joint being provided at one end of each arm to permit relative turning movement about an axis extending lengthwise of the arm.

Preferably each of said joints permitting relative turning movement is in the form of a ball joint at the forward end of each mounting arm, the ball joint also permitting up and down movement of the rear end of the mounting arm. A pair of remotely operable actuators may act one between each mounting arm and the frame, said actuators being operable both to raise and lower the brush and to change the downthrust on the brush during sweeping.

Preferably the mounting means for the brush further comprises a brush attitude change-over mechanism whereby the main brush can be set at the attitude appropriate for sweeping material to opposite ends of the brush, the change-over mechanism comprising a change-over lever pivotally connected between the frame and one of the mounting arms and serving to transmit draught forces to said one mounting arm, and adjustment means for the change-over lever whereby the attitude of the change-over lever can be changed, so as to move said one mounting arm in the fore-aft direction and change the main brush from one sweeping mode to the other. A change-over lever may be provided for each mounting arm. Each mounting arm may be connected at its rear end to the main brush by a pivot joint having a pivot axis lying in a generally vertical plane and substantially at right angles to the longitudinal axis of the mounting arm. The adjustment means for the change-over lever may comprise a remotely operable actuator pivotally connected between the change-over lever and the frame.

A fifth aspect of the present invention relates to the structure of the rotatable cylindrical brush of road sweeping apparatus.

Previous proposals relating to the structure of the main brush have been subject to the serious shortcomings of lack of strength and rigidity. The cylindrical brush of road sweeping apparatus is subjected to very considerable wear and occasionally to severe impact such as when the apparatus passes over large objects in the road or the apparatus is obliged to mount the curb at the side of the road. In addition, the main brush needs a certain minimum stiffness and strength in order to cooperate properly with a mounting structure for it which permits it to follow road camber. Previously proposed main brush structures have been found to be seriously damaged by impacts during use, and it is an object of this aspect of the present invention to provide road sweeping apparatus having a cylindrical brush of improved strength and rigidity.

According to this aspect of the present invention there is provided road sweeping apparatus wherein the main brush comprises a steel beam having annular brush elements with outwardly projecting bristles, the brush elements being drivably connected to the beam so as to rotate therewith.

Preferably said beam extends along substantially the full length of the brush, the beam providing substantially the total torsional and bending strength of the brush. The steel beam may be of rectangular section. The beam may be of rolled hollow section steel. The brush elements may be drivably coupled to the beam by inwardly projecting pegs engageable with the beam.

A sixth aspect of the present invention relates to the refuse collecting nozzle of road sweeping apparatus which is provided to collect refuse swept by the brush gear, and more particularly to the mounting of such a nozzle.

Problems raised by presently available nozzle mounting apparatus include unsatisfactory maintenance of the required nozzle position in relation to the brush gear during cornering, and twisting of the suction tube connected to the nozzle, during raising of the nozzle from its working position—such twisting reducing the service life of the suction tube.

An object of this aspect of the present invention is to provide road sweeping apparatus offering improvements in relation to one or more of the problems identified above.

According to this aspect of the present invention there is provided road sweeping apparatus wherein the refuse collecting nozzle is connected to the frame or body through a linkage permitting both up and down as well as lateral movement of the nozzle, and also adapted to move the nozzle between a raised and retracted transport position and a lowered and extended working position.

Preferably the refuse collecting nozzle comprises road-engageable wheels mounted for pivotal movement about respective castor axes whereby the wheels exert no steering effect on the nozzle. Said linkage connecting the refuse collecting nozzle to the frame may be provided with a pivot having an upwardly extending pivot axis permitting limited inward turning of the nozzle as the nozzle is moved to its working position whereby twisting of the air duct connected to the nozzle is reduced. A fixed stop may be provided to limit extension of the thrust device and thereby define the working position of the nozzle. The air duct may be connected to the nozzle so as to be put in tension by extension of the thrust device, such tension opposing further extension of the thrust device and serving to define the working position of the nozzle.

A seventh aspect of the present invention relates to a further aspect of the mounting of the refuse collecting nozzle of road sweeping apparatus.

Certain problems arise in relation to conventionally mounted refuse collecting nozzles which have apparently remained unsolved. For example, in autumn the problem arises that large quantities of wet leaves are encountered by road sweeping apparatus and these can build up in front of a conventionally mounted suction nozzle to such an extent that the nozzle is incapable of dealing with them. Similar problems can arise in relation to the various heavy objects such as bricks which are encountered by a road sweeper during use.

If the refuse collecting nozzle is designed and mounted so that the refuse intake opening of the nozzle is at all times able to accommodate and take in such materials and objects then the problem arises that the relatively large gap through which air can thereby enter the nozzle results in a relatively slow air velocity and unsatisfactory refuse collecting performance by the nozzle during normal sweeping work.

An object of the present invention is to provide road sweeping apparatus offering improvements in relation to the problems identified above.

According to this aspect of the invention there is provided road sweeping apparatus wherein the nozzle is mounted on a support for pivotal motion relative to said support about a lateral axis so as to raise the front edge of a refuse intake opening of the nozzle.

Preferably a remotely operable actuator is provided to effect pivotal movement of the nozzle about said axis. Said actuator may be mounted so as to act between said support and the nozzle. Said actuator may comprise a fluid pressure operated ram and said support may comprise a frame mounted on castor wheels.

An eighth aspect of the present invention relates to a method of making a refuse collecting nozzle for use in road sweeping apparatus. The invention also provides a nozzle manufactured in accordance with the method.

The nozzles of road sweeping apparatus are connected to very powerful fans. Usually an auxiliary engine is provided to drive the fan and substantially the whole power output of this engine is absorbed in generating the air flow through the nozzle. Therefore, aerodynamic design considerations are of considerable importance in relation to such nozzles.

Conventionally, such nozzles have been manufactured by casting techniques, and one well known nozzle is an aluminum casting. Such casting techniques enable the required aerodynamic profiles to be obtained quite readily in association with the fundamental design feature of such a nozzle which is to provide a connection between a relatively long narrow opening and a (usually) cylindrical hose or air duct connecting the nozzle to the refuse tank.

An object of this aspect of the invention is to provide a method of making a nozzle for use in road sweeping apparatus, which is less expensive than currently used techniques such as casting, and/or which provides an improved nozzle structure.

Embodiments of the invention will now be described by way of example with reference to the accompanying drawings in which:

FIG. 1 shows a side elevation view of road sweeping apparatus according to the invention mounted on a self-propelled chassis to form a road sweeping vehicle;

FIG. 2 shows, diagrammatically, mounting means for the scarifying or narrow sweep brush of the road sweeping apparatus of FIG. 1, showing the relative dispositions of inner and outer mounting links, three actuators connected to the links and an associated resilient mounting for the whole assembly;

FIG. 7 shows a rear elevation view of the refuse collecting nozzle of FIG. 6, the direction of viewing being indicated by arrow VII in FIG. 6 and the nozzle support shown in FIG. 6 not being shown; and FIG. 8 shows an end elevation view of the nozzle of FIG. 7, the direction of viewing being indicated, by arrow VIII in FIG. 7.

Figure 3:
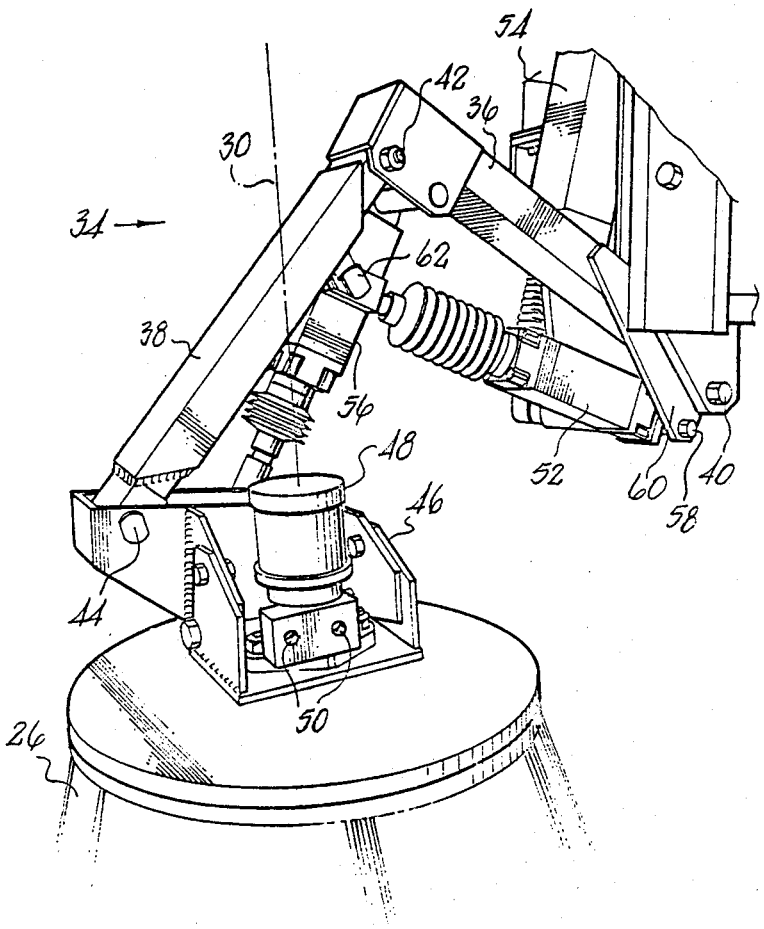
FIG. 3 shows a perspective view of the mounting means of FIG. 2, the direction of viewing being indicated, approximately, by the arrow III in FIG. 1.

As shown in FIG. 1, a road sweeper 10 comprises a self-propelled chassis 12, having a driver's cab 14 and road sweeping apparatus 16 mounted on the chassis.

Road sweeping apparatus 16 comprises a frame or body 18, brush gear 20 and mounting and drive means therefor, a refuse collecting nozzle 22 and a refuse tank 24.

Frame 18 serves to support substantially the entire road sweeping apparatus 16 so that such apparatus can be mounted as a unit on chassis 12.

Brush gear 20 comprises a narrow sweep or scarifying brush 26 and a cylindrical wide sweep or main brush 28. Scarifying brush 26 is rotatable in direction R1 (FIG. 4) about an upwardly extending axis 30 (FIGS. 2 and 3) to effect sweeping in the region of one side of the road sweeping apparatus. Wide sweep brush 28 is cylindrical in form and extends laterally with respect to the direction F of operative forward motion of the road sweeping apparatus during use. The wide sweep brush is mounted at an attitude with respect to direction F so as to sweep material towards one end of the brush.

Refuse collecting nozzle 22 is mounted behind brush gear 20 and positioned in relation thereto so as to collect refuse material swept by the brush gear. The nozzle is connected by an air duct 32 to refuse tank 24 which in turn is connected by a further air duct (not shown) to a fan assembly (not shown) driven by an auxiliary engine, whereby the fan assembly can be caused to generate suction at the nozzle so as to draw refuse into the tank.

The structure for mounting the narrow sweep brush 26 will now be described in greater detail with reference to FIGS. 2 and 3.

The mounting means 34 for mounting scarifying brush 26 on frame 18 comprises an inner mounting link 36, an outer mounting link 38 and actuating means for the links. The inner link 36 is connected at its inner end through a pivot 40 to the frame 18, and is connected by a pivot 42 at its outer end to the adjacent end of outer mounting link 38.

Outer mounting link 38 itself is connected by a pivot 44 at its outer end to scarifying brush 26 through a mounting bracket assembly 46 thereon. Bracket assembly 46 carries a hydraulic motor 48 which is drivably connected to brush 26 and supplied with hydraulic fluid via connections 50 from a pump driven by the auxiliary engine of the road sweeper, so as to rotate brush 26 about axis 30.

The actuating means for the inner and outer mounting links 36 and 38 is connected to the links and is operable to cause angular movement of the links relative to each other whereby the linkage formed thereby extends and retracts moving the scarifying brush 26 inwards and outwards relative to the frame 18. Such inward and outward movement is needed to accommodate varying road configurations and movement of the road sweeper towards and away from the edge of the road. A further requirement for such movement is in association with lifting of the brush to move the brush to its retracted transport position.

The actuating means for the mounting links comprises primary, secondary and tertiary remotely operable actuators in the form of pneumatic rams 52, 54 and 56 respectively which are connected to a source of pneumatic pressure, and associated control valves (not shown). A compressor (not shown) driven by the engine of the road sweeper chassis 12 forms the source of pneumatic pressure, and is provided with a reservoir and conventional pneumatic control valves.

The axes of all the pivot connections of mounting means 34 for scarifying brush 26 are substantially horizontal. Primary ram 52 is connected by a pivot 58 at its inner end to a bracket 60 fixed to inner mounting link 36, and at its outer end ram 52 is connected by a pivot 62, to outer mounting link 38. Thus, ram 52 is connected between the inner and outer mounting links so as to be extensible and retractable to cause the linkage formed thereby to fold and likewise to extend and retract so as to move scarifying brush 26 inwards and outwards relative to frame 18.

Secondary pneumatic ram 54 is connected by a pivot 64 at its upper end to a mounting bracket 66 which is itself connected to frame 18 through resilient mounting means described below. The lower end of ram 54 is connected by a pivot 68 to inner mounting link 36. Thus, the secondary actuator or ram 54 is connected between the frame and the inner mounting link so as to be operable to raise and lower the outer end of the inner mounting link, and hence to raise and lower scarifying brush 26 between its working position and a relatively high stowed position. Ram 54 can also be pressurized during work to increase downthrust on brush 26.

It is to be noted that in the diagrammatic representation of mounting means 34 as shown in FIG. 2, ram 54 is shown to be directly connected by pivot 68 to inner mounting link 36. In the practical embodiment shown in FIG. 3, it can be seen that ram 54 is not directly connected to inner mounting link 36 in the manner shown in FIG. 2. In fact, this connection is through a short lever arm (not shown) which is itself rigidly connected to link 36 and the principle of operation is thus correctly shown in FIG. 2.

Outer mounting link 38 comprises spaced apart first and second link elements 70 and 72 which are pivotally connected between mounting bracket 46 on scarifying brush 26 and the inner mounting link 36.

Link elements 70 and 72 converge slightly in the upward direction whereby the geometry of the linkage so formed is such that the attitude of scarifying brush 26 relative to the road surface being brushed changes as the brush moves inwards and outwards, thereby to maintain a satisfactory brush-to-road contact angle. Many alternatives to the geometry of the linkage shown in the drawings could of course be adopted. It is to be noted in this connection that FIG. 2 is diagrammatic and the angular inclinations shown therein are not definitive.

Second link element 72 is in fact formed by the tertiary pneumatic ram 56 which is operable to change the attitude of brush 26. Ram 56 has a stroke length such that extension and retraction of the ram between the limits of its stroke length is such as to change the attitude of brush 26 between an attitude appropriate for roads of normal camber and an attitude appropriate for roads of extreme camber.

The inner end of inner mounting link 36 is connected to frame 18 through resilient mounting means 74 which permits angular movement of the inner mounting link about an upwardly extending axis 76 so that the scarifying brush 26 can yield under impact with fixed objects encountered during movement of the road sweeping apparatus in direction F during use.

The resilient mounting means 74 serves to connect mounting bracket 66, which supports pivots 40 and 64, to frame 18. The resilient mounting means comprises a metal-to-rubber-to-metal torsion spring assembly having two such torsion springs 78 and 80. Each torsion spring comprises an annulus of rubber bonded between an outer metal member or casing seen in FIG. 2 and a central inner torque-transmitting metal member (not shown). The outer metal casing of springs 78 and 80 are welded to mounting bracket 66 and the inner torque-transmitting members of the springs are connected to frame 18 for the transmission of torsion by brackets 82 and 84 and associated pins 86 and 88.

It can now be seen that the inner end 40 of inner mounting link 36, and the upper end 64 of secondary ram 54 are connected through resilient mounting means 74 so that scarifying brush 26 and its entire mounting means 34 can yield under impact and turn about axis 76—no ball joints being needed for such yielding.

To define the attitude of inner mounting link 36 about axis 76 in the normal working position of brush 26, a stop (not shown) is provided. The stop is mounted on frame 18 and is engaged by an adjustable abutment (not shown) carried by mounting plate or bracket 66. The stop comprises a rubber block bonded between two metal plates. Torsion springs 78 and 80 are pre-loaded during assembly so as normally to hold the abutment against the stop so as to define the working position of brush 26.

Sensing means (not shown) may be provided to sense angular movement of the inner mounting link 36 about axis 76, the sensing means being responsive upon said angular movement exceeding a predetermined maximum to generate a signal to cause pneumatic rams 52 and 54 to move brush 26 inwards and upwards.

During use, pneumatic rams 52, 54 and 56 are controlled by means of a push button system incorporating solenoid valves whereby the driver of the road sweeper can, by actuating a single push button, move scarifying brush 26 between its working and transport positions. Furthermore, during sweeping the brush 26 floats in the lateral direction in response to variations in the position of the vehicle relative to the curb. The downward pressure exerted on brush 26 can be increased during use by supplying pressure to ram 54 so as to increase the aggressivity of the sweeping action. During floating inward and outward movement of the brush, its attitude relative to the road surface is automatically adjusted by the geometry of the linkage provided by link elements 70 and 72. The brush to road contact angle increases as the brush moves inwards, thereby reducing the effective brushing width of the brush and preventing material being swept too far inwards relative to the suction nozzle 22. In addition, tertiary ram 56 can be retracted when necessary to bring the brush 26 to its extreme camber position for effective sweeping in deep gutters. Finally, if any unyielding obstacle is encountered the whole brush assembly can yield by pivotal movement about axis 76 against springs 78 and 80. When the obstacle has been passed, the torsion springs return the assembly to its normal working position.

Among the advantages provided by the embodiment of the invention described above are the simple and rugged mounting means for the brush, the unobtrusive and relatively high stowed position of the brush, the facility to change the attitude of the brush during use so as to take account of changes in road camber and deep gutters, automatic maintenance of brush-to-road contact angle at varying brush positions, and ability to yield resiliently under impact with fixed objects.

Numerous variations in design can of course be made in the above embodiment without departing from the scope of the invention defined in the accompanying claims. Such changes include:

1. the use of narrow sweep brushes rotatable about non-vertical (eg. horizontal) axes;
2. the use of different brush mounting linkages in association with the resilient mounting means 74 and the brush tilting ram 56;
3. the use of the narrow sweep brush in a mechanical road sweeper using mechanical means to transfer swept material to the refuse tank;
4. the use of pairs of spaced links (parallel or nearly parallel) in place of the inner and/or outer mounting links;
5. the use of hydraulic rams in place of the pneumatic rams, preferably with some cushioning means (such as a gas accumulator) to provide a degree of resilience;
6. the use of a fixed length link in place of pneumatic ram 56 in the case where remote control of brush angle is not required;
7. the use of a single actuator in place of rams 52 and 54 and connected between (approximately) pivots 62 and 64 (see FIG. 4) to effect both lateral and up and down movement of brush 26; and
8. the use of a rotary actuator in place of ram 56.

Figure 4:
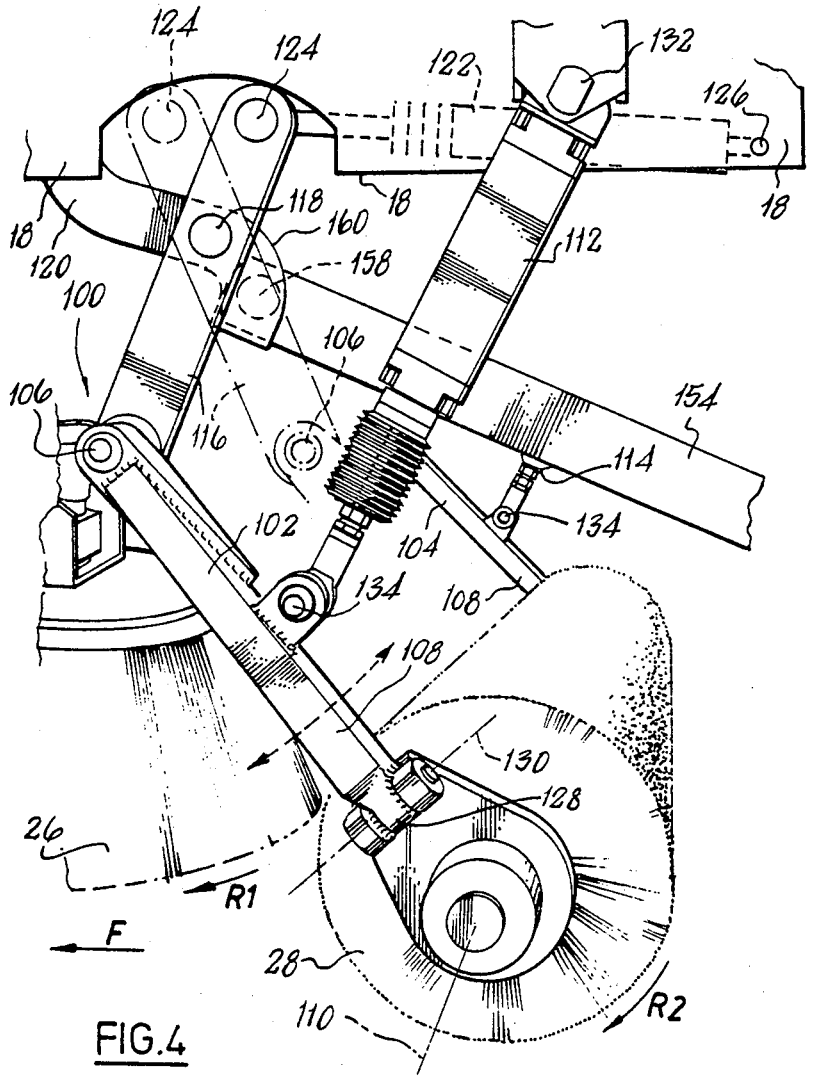
FIG. 4 shows a perspective view of the cylindrical main brush of the road sweeping apparatus of FIG. 1 together with mounting means therefor, the direction of viewing being indicated, approximately, in FIG. 1 by the arrow IV.

Turning now to the mounting of the wide sweep brush 28 shown in FIG. 4, mounting means 100 for brush 28 comprises left and right mounting arms 102 and 104 respectively, connected between brush 28 and the frame 18, one arm at each end of the brush. Each of the mounting arms is connected by a pivot joint 106 at its forward end (having regard to direction F) to frame 18 so that the rear end 108 of the arm can execute up and down movement about pivot 106. Brush 28 is rotated in direction R2 by a hydraulic motor (not seen in FIG. 4) at the same end of the brush as arm 104.

In order to permit independent up and down floating movement of the ends of wide sweep brush 28 to follow road contours, a joint at one end of each of the arms 102 and 104 is provided which permits limited amounts of relative turning movement about an axis extending lengthwise of the arm, between the arm and the structure to which the arm is connected at said one end. In this embodiment the joint permitting such relative turning movement is in the form of a ball joint at the forward end of each mounting arm, the ball joint constituting pivot joint 106, which thus also permits the up and down movement of the rear end 108 of each mounting arm.

An alternative arrangement would be to provide a simple fixed horizontal axis pivot joint at 106 and to provide a ball joint on the axis 110 of brush 28.

A pair of remotely operable actuators in the form of pneumatic rams 112 and 114 are connected one between each mounting arm 102 and 104, and the frame 18. The rams are operable both to raise and lower the wide sweep brush and to apply either a downwardly-directed thrust to the brush during sweeping so as to render the brushing action on the road more aggressive, or a limited upwardly-directed thrust to reduce aggressiveness.

Mounting means 100 further comprises a brush attitude change-over mechanism whereby the wide sweep brush 28 can be set at the attitudes appropriate for sweeping material to opposite ends of the brush. The change over mechanism comprises two change-over levers 116 provided one at each end of the brush and each lever pivotally connected both to frame 18 and to its respective mounting arm 102 or 104. The change-over levers serve to transmit draught forces to the mounting arms 102 and 104 and to provide the necessary adjustment of the mounting arms' positions.

Thus, change-over lever 116 shown in FIG. 4 is pivotally mounted at 118 on a bracket 120 which is rigidly fixed to frame 18. At its lower end, lever 116 is pivotally connected by ball joint 106 to the upper end of mounting arm 102. At its upper end, lever 116 is pivotally connected to adjustment means in the form of a pneumatic ram 122 which is pivotally connected at 124 to the lever and at 126 to the frame 18. Actuation of ram 122 enables the attitude of change-over lever 116 to be changed so as to move mounting arm 102 in the fore-aft direction and to change the wide sweep brush from one sweeping mode to the other.

Each mounting arm 102 and 104 is connected to wide sweep brush 28 at its rear end 108 by a pivot joint 128 having a pivot axis 130 extending substantially at right angles to the longitudinal axis of the respective mounting arm 102 or 104. Pivot 128 of arm 102 is welded solid during assembly after setting brush 28 at the correct lateral position relative to the road sweeper as a whole.

Pneumatic rams 112 and 114 have ball joints 132 and 134 at their upper and lower ends to accommodate the out-of-vertical-plane movements of the mounting arms as brush 28 follows road camber and is moved between sweeping modes.

In use, rams 112 and 114 raise and lower wide sweep brush 28 between its working and transport positions and apply downward loading when aggressive sweeping is required, and zero or upward loading for less aggressive sweeping. Change-over between brushing modes is accomplished by actuation of rams 122 (one is extended and the other retracted). If change-over is not needed in a given machine rams 122 can be replaced by fixed links, or levers 116 can be welded to and form part of frame 18.

As the road camber changes during sweeping, brush 28 floats freely and independently of frame 18. Each end of the brush can freely rise and fall by virtue of the articulation permitted by ball joints 106.

In FIG. 4, change-over lever 116 is also shown (in dotted lines) in an alternative position corresponding to the other sweeping mode of brush 28.

Modifications which could be made in this embodiment include the use of rubber-to-metal type joints in place of the ball joints 106, 132 and 134. Also, only one change-over lever 116 need be used if it is of sufficient length to provide the necessary fore-aft movement of joints 106. Alternative means may be provided of accommodating the small angular movements of arms 102, 104 to accommodate movement of brush 28 between sweeping modes and to follow road camber.

Advantages arising from the form of brush mounting means 100 described above include its simple and robust form, the provision it makes for free floating movement of brush 28, the location of rams 112 and 114 at relatively high locations out of the dirt zone, the provision of remote-controlled means for change-over between sweeping modes of brush 28, and good ground clearance in the transport position.

Figure 5:
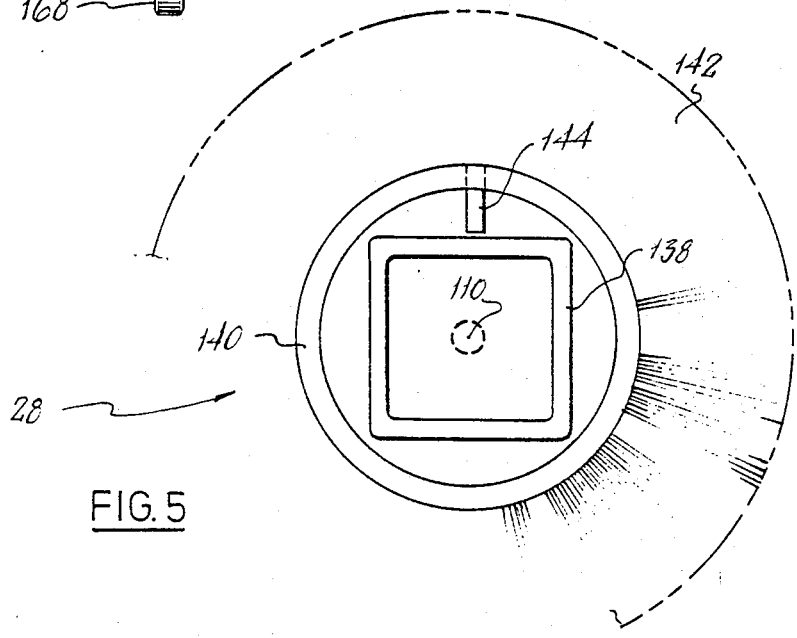
FIG. 5 shows diagrammatically, a cross-section through the cylindrical main brush of FIG. 4, the section being taken at right angles to the axis of rotation of the brush.

The structure of wide sweep brush 28 is shown in FIG. 5 which, it is emphasized, is diagrammatic.

Wide sweep brush 28 is generally cylindrical in form and is mounted for rotation about axis 110 by means of a hydraulic motor (not shown) located at the right hand end of the brush. Brush 28 provides a major part of the sweeping width of road sweeping apparatus 16, and comprises a steel beam 138 extending along substantially the full length of the brush and having annular brush elements in the form of segments or sleeves 140 carrying outwardly projecting bristles 142 and located on the beam.

Segments 140 are drivably coupled to beam 138 so as to rotate therewith, by means of inwardly projecting pegs 144 engageable with the beam.

Substantially the total torsional and bending strength of brush 28 is provided by steel beam 138, and it will be understood that the very considerable strength of the beam enables the brush to withstand very serious impacts, such as driving up a curb, without sustaining any significant structural damage. The bending stiffness of the beam also avoids insufficient kinematic constraint of the brush head. Brush segments 140 are extremely simple to replace.

In this embodiment, the steel beam is of rectangular section rolled hollow section steel. Possible modifications include the use of a round section beam and of non-square section steel as such but formed, for example, by welding together channel sections. The brush elements may be helical in form.

The next feature of road sweeper 10 to be considered is the method of mounting the refuse collecting nozzle 22, which is connected by air duct 32 to the refuse tank 24 and hence to the air inlet of the fan whereby suction is applied to the nozzle so as to draw refuse into the tank. This aspect of the invention will now be described with reference to FIGS. 1 and 6 of the drawings.

Nozzle 22 is connected to frame 18 of the road sweeper through a linkage 146 which permits both up and down movement, and movement in a lateral direction L with respect to the direction F of normal operative forward movement of the road sweeping apparatus 16, and rolling movement about a fore-aft axis to accommodate road camber.

Linkage 146 is shown in FIG. 1, and nozzle 22 is moveable on the linkage between a raised and retracted transport position (not shown), and a lowered and extended working position shown in FIG. 1. A remotely operable actuator in the form of a pneumatic ram 148 acts between frame 18 of the road sweeper and linkage 146 and hence nozzle 22. Ram 148 is connected in this manner through respective ball type joints 150 and 152 so as to permit the necessary articulation during such movement.

Ram 148 extends, in the working position of nozzle 22, downwardly and laterally with respect to direction F from its upper end connected by ball joint 150 to frame 18, to its lower end connected by ball joint 152 to linkage 146 and hence to nozzle 22, whereby the ram can move the nozzle between the latter's transport and working positions.

Nozzle-mounting linkage 146 comprises a drawbar 154 connected at its forward end to frame 18 and connected at its rearward end to a support in the form of a generally U-shaped frame 156 on which nozzle 22 is mounted. A ball joint 158 is provided at the forward end of drawbar 154 to connect it to an extension 160 of bracket 120 seen in FIG. 4, whereby the drawbar can move both up and down and laterally, and can execute limited turning movement about its longitudinal axis. At its rearward end the drawbar is pivotally connected by a pin (not shown) between upper and lower plates 162 on the forward portion of frame 156.

Figure 6:
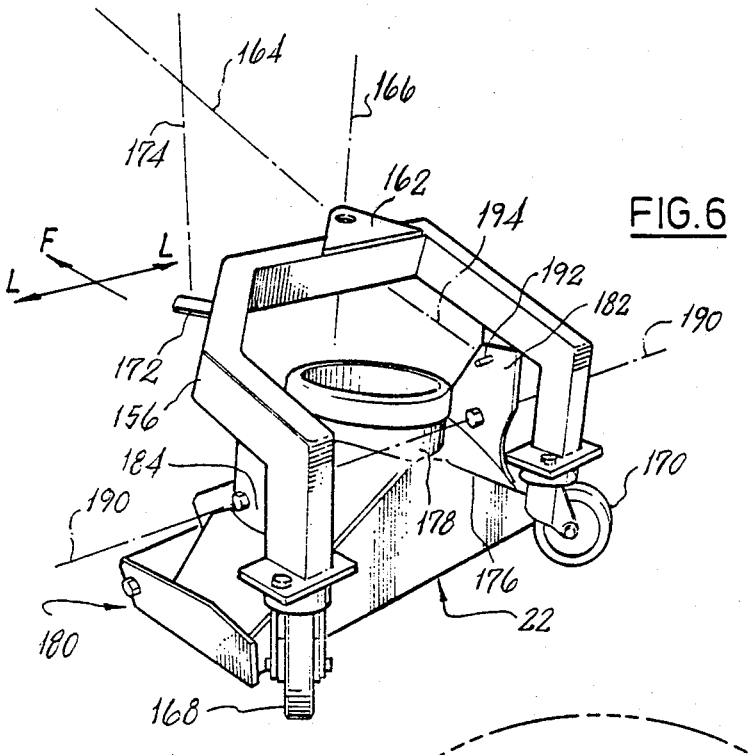
FIG. 6 shows a perspective view of the refuse collecting nozzle of the road sweeping apparatus of FIG. 1, the nozzle being viewed from the side and the rear and the direction of viewing being indicated, approximately, in FIG. 1 by the arrow VI.

In FIG. 6 the line of action of drawbar 154 is indicated by dotted line 164 and the axis of the pivotal connection of the drawbar to frame 156 is indicated by line 166.

Frame 156 straddles nozzle 22 and carries at its rear end a pair of road-engageable castor wheels 168, 170 which are mounted for pivotal movement about respective castor axes whereby the wheels exert no steering effect on the nozzle.

A connection pin 172 projects laterally and forwardly from frame 156 at the front left hand portion thereof to receive ball joint 152 at the lower end of ram 148. The line of action of ram 148 is indicated in FIG. 6 by broken line 174 which extends upwardly and laterally inwardly from pin 172.

Stop means (not shown) is provided to act between drawbar 154 and frame 156 whereby pivotal movement between the two about axis 166 is limited, for a purpose to be described.

In the raised and retracted position of nozzle 22, the line of action of ram 148 is approximately ten degrees from the vertical, whereby extension of the ram moves linkage 146 outwardly and downwardly and positively places nozzle 22 in its working position. The nozzle is positively held in its working position by pressure in ram 148 during sweeping. The geometry of the nozzle mounting apparatus described results in frame 156 experiencing a turning moment about axis 166 during sweeping so that frame 156 is held in the position defined by the stop means between the frame and drawbar 154.

Upon retraction of ram 148 to raise nozzle to its transport position, an oppositely directed moment is exerted upon frame 156 whereby it moves to the other limit of its travel about axis 166. This limited turning of the nozzle during movement between the working and transport positions is proportioned so as to correspond to the inherent turning of the end of air duct 32 in moving between the transport and working positions of the nozzle whereby twisting of the air duct is reduced or eliminated.

A fixed stop (not shown) may be provided to limit extension of ram 148 so as to positively define the working position of nozzle 22. Alternatively, air duct 32 may be arranged so as to be put in tension by extension of the ram and serve to define the working position of the nozzle.

Advantages provided by the above-described nozzle mounting assembly include its simplicity and ruggedness, the use of a single ram to move the nozzle both downwardly and laterally, the positive placement of the nozzle in its working position and the avoidance of undue twisting of the air duct connected to the nozzle.

Modifications to the above embodiment include the use of hydraulic, electric or other rams in place of pneumatic ram 148.

Another aspect of the nozzle mounting assembly shown in FIG. 6 will now be considered.

The detailed shape and method of fabrication of the nozzle will be described below with reference to FIGS. 7 and 8, however, as shown in FIG. 6 the nozzle has a generally funnel-shaped structure including a main body portion 176, an upper connector tube 178 to be connected to air duct 32, and a lower intake opening having a front edge 180.

Nozzle body 176 has welded thereto a pair of upwardly extending mounting flanges 182 which are located between a pair of complementary downwardly extending flanges 184 welded to frame 156. A pair of pivot pins 186 and 188 define a pivot axis 190 extending laterally with respect to direction F whereby nozzle 22 can execute limited angular movement about axis 190 from its normal working position as shown in FIG. 6 to a position in which front edge 180 of the refuse intake opening of the nozzle is raised to admit large objects such as bricks or piles of leaves.

A remotely operable actuator in the form of a pneumatic ram is provided to pivot nozzle 22 about axis 190. The ram is connected between a pivot pin 192 fixed to one of the flanges 182 of nozzle 22, and a bracket (not shown) mounted at the lower edge of the front of frame 156. In FIG. 6 the line of action of the ram is indicated by broken line 194. The ram could be replaced by a hydraulic or electric ram or indeed by an alternative remotely operable mechanical means such as a Bowden cable.

In use, during normal sweeping operations the nozzle is held in its normal working position as shown in FIGS. 1 and 6. However, when the driver of the vehicle notices a build-up, for example, of leaves in front of the nozzle, he operates a push button to extend ram 194 causing nozzle 22 to pivot about axis 190 whereby the leaves are quickly and easily sucked into the nozzle and deposited in refuse tank 24.

This facility for tilting the nozzle from the driver's cab considerably improves the capability of the road sweeper for coping with difficult conditions. It is found in practice that drivers are usually not able or willing to take steps to cope with such conditions if it is necessary for them to stop the vehicle, dismount and make an adjustment to the nozzle gear at the roadside.

Turning now to the structure of nozzle 22 as shown in FIGS. 7 and 8, it will be seen that the nozzle comprises upper connector tube 178 having an upper tubular portion 200 and a pair of opposed downwardly tapering flanges 202 and 204 on opposite sides of the upper tubular portion and at the lower edge thereof.

A pair of shoulder members 206, 208 of channel section fit against the tapering flanges 202 and 204 and are secured thereto by welding.

The nozzle is completed by a pair of front and rear flat plates 210 and 212 respectively, secured between the shoulder members 206 and 208, and by a pair of end plates 214 and 216. The end plates each comprise a rectangular flat lower portion 218 and a flat curved upper portion 220 shaped to conform with the end profile of shoulder members 206 and 208.

The method of making nozzle 22 is as follows. The nozzle is made entirely from cylindrical tube or the like cut to shape, and from substantially flat plate likewise cut to shape. No shaping operations are involved and all that is required is template cutting of the nozzle components from standard steel tube and standard steel plate, followed by welding. Sheet material rolled to a cylindrical or circular arc form could be used in place of steel tube.

Upper connector tube 178 and shoulder members 206 and 208 are all cut from 25.4 cm. diameter steel tube of 3 mm. nominal thickness. Flat plates 210, 212 and end plates 214, 216 are likewise cut to shape from 3 mm. thickness steel plate. All shaping is achieved by use of templates in association with suitable metal cutting means such as an oxy-acetylene torch.

The previously template-cut nozzle components are simply seam welded together to form nozzle 22. The nozzle may then be subjected to the further step of bonding a rubber lining over its inside surface to provide it with extra durability and corrosion resistance, and to reduce noise generation.

The principal advantage of this embodiment of the invention lies in the simple and inexpensive method of producing a nozzle having the necessary curved surfaces for satisfactory aerodynamic characteristics. Furthermore, a fabricated steel structure is less likely to suffer from fracture damage than, for example, a cast aluminum structure. Also the leading edge of the nozzle is provided by a wedge shaped member which is very strong and better able to resist impacts from raised gratings and bricks in the road. Moreover, the fabricated steel structure is relatively easy to repair.

We claim:

1. Road sweeping apparatus comprising:

a frame or body;

a brush and mounting and drive means therefor whereby the brush is rotatable to effect sweeping in the region of one side of the apparatus;

a refuse tank;

refuse collecting and transfer means associated with the brush to collect material swept by the brush and to transfer the material to the tank;

the mounting means for mounting the brush on the frame or body comprising:

an inner mounting link;

an outer mounting link; and actuating means for said links;

the inner mounting link being connected at its inner end to the frame or body and being pivotally connected at its outer end to the adjacent end of the outer mounting link;

the outer mounting link being connected at its outer end to the brush; and the actuating means being connected to said links and being operable to cause angular movement of the links relative to each other whereby the linkage formed thereby extends and retracts moving the brush inwards and outwards relative to the frame.

2. Apparatus according to claim 1 wherein the axis of the pivotal connection between the mounting links is substantially horizontal and said actuating means comprises a remotely operable primary actuator connected to the outer mounting link and retractable to cause said linkage to fold.

3. Apparatus according to claim 2 wherein said actuating means further comprises a remotely operable secondary actuator connected at one end to the frame and at the other end to said linkage and operable to raise and lower the brush.

4. Apparatus according to claim 2 wherein the outer mounting link comprises spaced apart first and second link elements each pivotally connected between the brush and the inner mounting link.

5. Apparatus according to claim 4 wherein said link elements converge in the upward direction so that the attitude of the secondary brush relative to the road changes as the brush is moved inwards, thereby to maintain satisfactory brushing action.

6. Apparatus according to claim 4 wherein one of the link elements of the outer mounting link comprises a remotely operable actuator which is operable to change the attitude of the brush.

7. Apparatus according to claim 6 wherein said remotely operable actuator comprises a ram having a stroke length such as to change the attitude of the brush between an attitude appropriate for roads of normal camber and an attitude appropriate for roads of extreme camber.

8. Apparatus according to claim 1 wherein an inner end of the inner mounting link is connected to the frame through resilient mounting means.

9. Apparatus according to claim 8 wherein said resilient mounting means permits angular movement of the inner mounting link about an upwardly extending axis so that the brush can yield under impact with fixed objects encountered during movement of the road sweeping apparatus in the normal forward direction during use.

10. Apparatus according to claim 9 wherein said resilient mounting means comprises a metal-to-rubber-to-metal torsion spring assembly, and a mounting plate resiliently connected to the frame through said torsion spring assembly, the inner end of said inner mounting link being pivotally connected to said mounting plate and a remotely operable secondary actuator being pivotally connected between the mounting plate and said linkage so as to be operable to raise and lower the brush, whereby the brush and its entire mounting means can yield under impact.

11. The road sweeping apparatus of claim 10 wherein a stop is provided to define the attitude of said inner mounting link about the axis of said resilient mounting means in the working position of said brush, said torsion spring assembly being preloaded so as normally to hold the inner mounting link, or a part associated therewith, in contact with the stop.

12. The road sweeping apparatus of claim 9 including sensing means to sense angular movement of the inner mounting link about said upwardly extending axis and responsive upon said angular movement exceeding a predetermined maximum, to generate a signal to cause said actuating means to move the brush inwards.

13. Road sweeping apparatus comprising:

a frame or body;

brush gear and mounting and drive means therefor whereby a brush in the brush gear is rotatable to effect sweeping in the region of one side of the apparatus;

said brush gear including a rotatable cylindrical brush disposed rearwardly of said first-mentioned brush and extending laterally with respect to the direction of operative forward motion of the apparatus during use, the mounting means for said cylindrical brush comprising trailing mounting arms connected between the cylindrical brush and the frame or body, one arm at each end of the cylindrical brush, each mounting arm being pivotally connected at its forward end, having regard to said direction of operative forward movement of the apparatus, to the frame so that the rear end connected to said cylindrical brush can execute up and down movement, the mounting means including a joint at one end of each arm permitting relative turning movement about an axis extending lengthwise of the arm, between the arm and the structure to which the arm is connected at said one end;

a refuse tank;

refuse collecting and transfer means associated with said brush to collect material swept by said brush and to transfer the material to the tank; and an actuator connected to said brush and operable to adjust the attitude of said brush relative to the surface being swept.

14. The road sweeping apparatus of claim 11 wherein each of said joints permitting relative turning movement is in the form of a ball joint at said forward end of each mounting arm, the ball joint also permitting said up and down movement of the rear end of the mounting arm.

15. The road sweeping apparatus of claim 11 including a pair of remotely operable actuators positioned to act respectively between each mounting arm and the frame, said actuators being operable both to raise and lower the brush and to change the downthrust on the brush during sweeping.

16. The road sweeping apparatus of claim 11 wherein said mounting means further comprises a brush attitude change-over mechanism whereby said cylindrical brush can be set at the attitudes appropriate for sweeping material to opposite ends of the cylindrical brush, the change-over mechanism comprising a change-over lever pivotally connected between the frame and one of the mounting arms and serving to transmit draught forces to said one mounting arm, and adjustment means for the changeover lever whereby the attitude of the change-over lever can be changed, so as to move said one mounting arm in the fore-aft direction and change the cylindrical brush from one sweeping mode to the other.

17. The road sweeping apparatus of claim 16 wherein a change-over lever is provided for each mounting arm.

18. The road sweeping apparatus of claim 16 wherein each mounting arm is connected at its rear end to the cylindrical brush by a pivot joint having a pivot axis lying in a generally vertical plane and substantially at right angles to the longitudinal axis of the mounting arm.

19. The road sweeping apparatus of claim 16 wherein said adjustment means comprises a remotely operable actuator pivotally connected between the change-over lever and the frame.

20. Road sweeping apparatus comprising a frame or body; brush gear and mounting and drive means therefor whereby a brush in the brush gear is rotatable to effect sweeping in the region of one side of the apparatus; a refuse tank; refuse collecting and transfer means associated with said brush to collect material swept by said brush and to transfer the material to the tank; and an actuator connected to said brush and operable to adjust the attitude of said brush relative to the surface beng swept; said refuse collecting and transfer means including a refuse collecting nozzle associated with the brush gear to collect refuse swept by the brush gear, a fan assembly, air ducts connecting the fan assembly to the refuse tank and connecting the refuse tank to the refuse collecting nozzle whereby the fan assembly can be caused to generate suction at the nozzle so as to draw refuse into the tank, the refuse collecting nozzle being connected to the frame or body through a linkage permitting both up and down movement and movement in a lateral direction with respect to the direction of operative forward movement of the road sweeping apparatus, the nozzle being movable on said linkage between a raised and retracted transport position, and a lowered and extended working position, and a further actuator positioned to act between the frame or body and the nozzle, the line of action of said further actuator extending in the working position of the nozzle downwardly and laterally with respect to said direction of operative forward movement, from the upper end of said further actuator, and the further actuator serving to move the nozzle between the latter's transport and working positions.

21. The road sweeping apparatus of claim 20 wherein said refuse collecting nozzle comprises road-engageable wheels mounted for pivotal movement about respective caster axes whereby the wheels exert no steering effect on the nozzle.

22. The road sweeping apparatus of claim 20 wherein said linkage connecting the refuse collecting nozzle to the frame is provided with a pivot having an upwardly extending pivot axis permitting limited inward turning of the nozzle as the nozzle is moved to its working position whereby twisting of the air duct connected to the nozzle is reduced.

23. The road sweeping apparatus of claim 20 wherein a fixed stop is provided to limit extension of said further actuator and thereby define the working position of the nozzle.

24. The road sweeping apparatus of claim 20 wherein the air duct which is connected to the nozzle is put in tension by extension of said further actuator, such tension opposing further extension of said further actuator and serving to define the working position of the nozzle.

* * * * *